United States Patent [19]

Johnston

[11] Patent Number: 4,528,700

[45] Date of Patent: Jul. 16, 1985

[54] SUPPORT BELT AND BUCKLE THEREFOR

[76] Inventor: Lyman Johnston, 12 Boulton Dr., Toronto, Ontario, Canada

[21] Appl. No.: 600,548

[22] Filed: Apr. 16, 1984

[51] Int. Cl.[3] ..... A41F 3/02

[52] U.S. Cl. ..... 2/338; 2/DIG. 6; 24/171; 24/196; 24/306

[58] Field of Search ..... 2/338, DIG. 6; 24/68 E, 24/309, 163 R, 170, 171, 196, 265 R, 265 A, 306, 194, 16 R

[56] References Cited

U.S. PATENT DOCUMENTS

| | | | |
|---|---|---|---|
| 2,528,078 | 10/1950 | Quilter | 24/171 |
| 3,193,898 | 7/1965 | Holman | 24/196 |
| 4,390,014 | 6/1983 | Forman | 2/338 X |

FOREIGN PATENT DOCUMENTS

| | | | |
|---|---|---|---|
| 1315185 | 12/1962 | France | 2/338 |
| 629393 | 12/1961 | Italy | 2/338 |
| 2169 | of 1878 | United Kingdom | 24/171 |

*Primary Examiner*—James T. McCall
*Assistant Examiner*—L. Cranmer
*Attorney, Agent, or Firm*—William T. Howell

[57] ABSTRACT

In combination, a support belt and a buckle having a frame with a pair of opposed forward and rearward transverse members, the latter being secured to one end of the belt. The other end of the belt is adapted to pass through the frame and has means thereon for engagement with the outside of the belt after such passage. The frame has a slidably, rotatable tubular member movable towards and away from the forward transverse member and the tubular member has a pair of opposed planar faces joined by a pair of opposed curved faces, said faces providing a pair of opposed, relatively sharp edges. When the other end of the belt is passed through the frame by looping around the tube, then under the forward transverse member, and after engagement with the outside of the belt, the motion causes the tube to move towards the forward transverse member and also rotate so that the sharp edges engage the belt, one to press it against the forward transverse member and the other to press it where it loops around the tube, thus providing positive engagement.

2 Claims, 4 Drawing Figures

SUPPORT BELT AND BUCKLE THEREFOR

FIELD OF INVENTION

This invention relates to belts and buckles therefor and more particularly to a belt for encircling the lower part of the human body to provide support during strenuous activity, which belt has an adjustable, secure and quick fit buckle as a linkage for the ends of the belt.

PRIOR ART

Previously produced support belts for the lower part of the human body i.e. the abdomen and/or hips, have been designed to meet the requirements of light weight, comfort, ability to maintain position after adjustment with quick securement or release.

It is an object of the invention to provide such a belt and buckle therefor.

It is a further object of the invention to provide a belt and buckle therefor which can be economically made and which will effectively function without cutting or weakening of the webbing after repeated use.

SUMMARY OF THE INVENTION

The belt of the invention comprises a length of webbing, preferably made of artificial fibre to ensure little or no stretch, which webbing has a width sufficient to prevent folding and cutting into the flesh of the wearer, also providing area support. The inside of the webbing preferably has one or more rubber components with cut-away portions to assist circulation of air, which components are attached by means of self adhesive backing material, thus permitting quick adhesion or removal to another location on the inside of the belt.

One end of the webbing has a loop whereas the other end has a Velcro fastener secured to the side of the belt opposed to the side on which the rubber components are secured.

The belt has a buckle which includes a rectangular frame with opposed spaced apart tranverse members connected by opposed side members with the rearward tranverse member passing through the loop in the webbing, the forward tranverse member being free until the belt is secured. The side members carry a slidable cross bar which in turn supports a tube rotatable thereon. The tube has a pair of opposed planar faces separated by a pair of curved faces. The junction of one planar face with one of the adjacent curved faces provides a relatively sharp edge while the junction of the same planar face with the other curved face produces a rounded edge; the same applies to the other planar face. The curved faces and contoured edges enable the belt to be easily adjusted while the sharp edges cause the belt to stay in position when the buckle is closed.

The arrangement is such that the free end of belt is looped around the tube to emerge from the frame under the forward tranverse member. To adjust the tightness, the free end of the belt is then reversed and slides along one or the other of the curved surfaces in easy manner. When the required degree of tightness is attained, the free end is then reversed and the action forces the cross bar to move towards the forward tranverse member with the result that the tube will rotate until the opposed sharp edges exert their effect. One sharp edge bites into the webbing where it loops around the tube while the other sharp edge bites into the webbing where it bears against the forward tranverse member and the belt stays in position. The reason why the tube rotates on closure is that the pull is along one of the planar faces.

To release the buckle, the wearer simply grasps the tube and rotates it towards the forward member to a point where the webbing bears against a contoured edge and curved face; the belt web will then slide under the tension.

BRIEF DESCRIPTION OF THE DRAWINGS

The invention will now be described in relation to the accompanying drawings in which.

DESCRIPTION OF A PREFERRED EMBODIMENT

Figure 1:
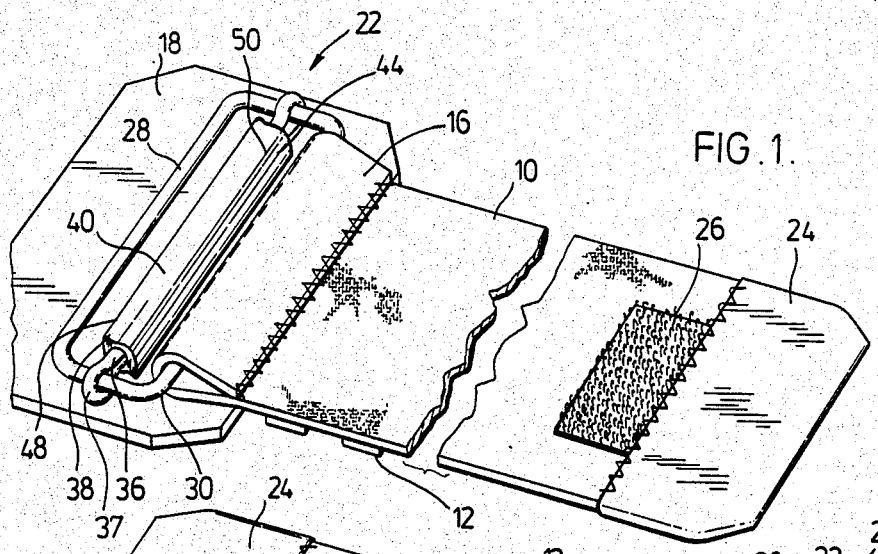
FIG. 1 is a perspective view of one side of a belt and disconnected buckle according to the invention, the mid-portion of the belt being omitted.
Figure 2:
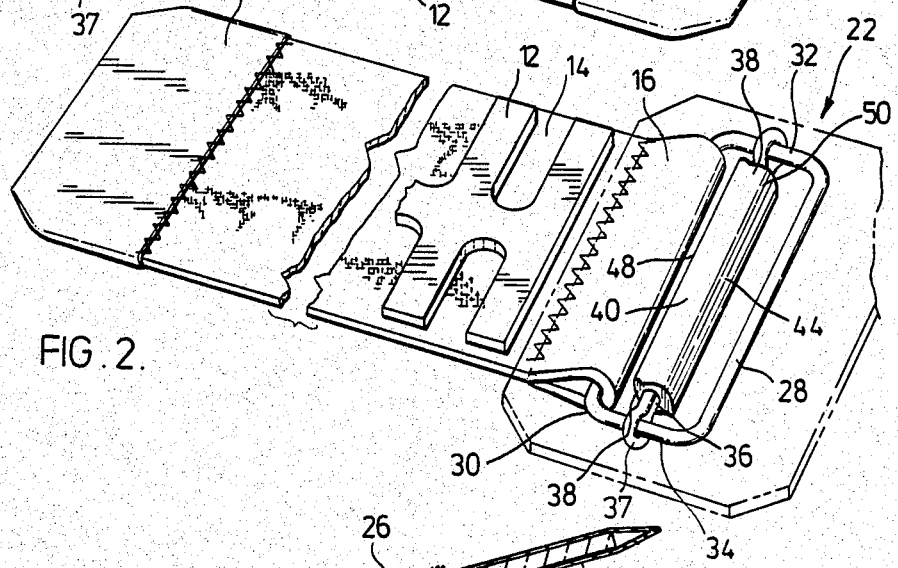
FIG. 2 is a perspective view of the other side of the belt showing a rubber component and fastener.
Figure 3:
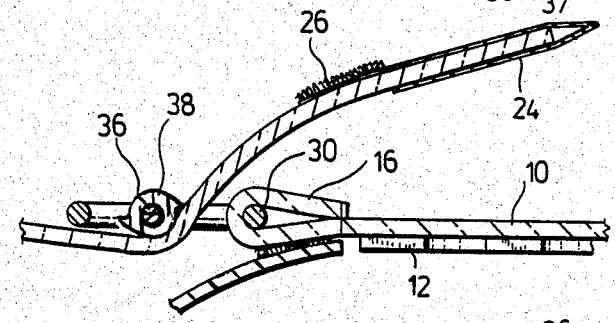
FIG. 3 is a cross section of the buckle shown in FIG. 1.
Figure 4:
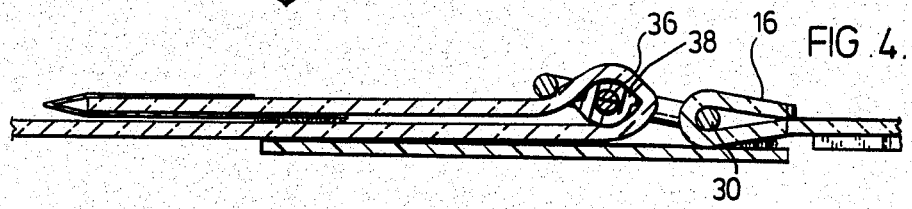
FIG. 4 is a cross section of the buckle with the belt in secured position.

In the description, and where particularly applicable, like numbers represent like parts.

The belt of the invention has a web 10, made of a material having minimal stretch characteristics such as artificial fibre, having a width sufficient to provide area support for the part of the human body to be encircled. The inside of the webbing is preferably provided with one or more soft rubber components 12 intended to increase the comfort of the wearer when the belt is in position. The components have cut out portions 14 intended to facilitate the circulation of air and alleviate the effect of perspiration on the skin. To permit easy positioning of the rubber components 12, they are backed with self adhesive material and Velcro fasteners for attachment to the inside of the belt web 10.

One end of the web 10 is formed in to a loop 16. A rubber backed leather pad 18 is secured to the web 10 adjacent the loop 16, the pad 18 extending from the web 10 as shown. The pad 18 provides a cushioning base for a buckle generally denoted by the numeral 22. The other, or free, end of the web 10 is provided with a leather stiffener and also an adjacent Velcro fastener 26 located on the side of the web 10 opposed to the side carrying the rubber components 12.

The buckle 22 comprises a frame formed of spaced apart forward and rearward transverse members 28 and 30 connected by side members 32 and 34; in the usual way, the corners of the frame are rounded. The buckle 22 is secured to the web 10 by locating the rearward transverse member 30 in the loop 16 prior to sewing the web 10.

The side members 32 and 34 support a sliding metal cross bar 36 by means of bifurcated end projections 37 which loosely straddle the side members 32 and 34.

The cross bar 36 carries a tube 38, generally of lozenge cross section, rotatable on the cross bar 36. The tube 38 is preferably made of plastic material for ease of manufacture. The tube 38 has opposed substantially planar faces separated by an opposed pair of curved faces 44. It is a feature that each face 40 forms a relatively sharp edge 48 with the curved face 44 on one side and each face 40 also forms a curved edge 50 with the curved face 44 on the other side.

The arrangement is such that when the belt is placed around the wearer, the leather stiffener 24 is inserted into the buckle frame 22 between the loop 16 and the tube 38; it is then looped around the tube 38 and brought out of the buckle frame 22 under the forward transverse member 28.

To tighten the belt, the stiffener 24 is pulled in a direction towards the loop 16 and, unless a curved surface 44 is already in contact with the web 10, the tube 38 will rotate until one of the curved surfaces 44 rides against the web, at which point, the web will slide easily under the tube 38.

When tightening has been sufficiently achieved, the stiffener 24 is then brought back in a direction away from the loop 16 and the stiffener 24 is attached to the outside of the web 10 by means of the Velcro fastener 26. In the tightening process, one of the sharp edges 48, acting as a cam surface, will bite into the web 10 on the tube 38 whilst the other sharp edge 48 will bite into the web 10 where it passes under the forward transverse member 28. At the same time the cross bar 36 will move towards the transverse member 28 and jam the tube 38 on its planar face 40 against the the transverse member 28 with the web 10 in between; the web 10 is also held in place because of its contact with the planar faces 40. As already stated, the web 10 will only slide when the contact is exclusively with the curved surfaces 44. It follows that, to release the belt, all that is necessary is to flip and rotate the tube towards the forward transverse member 28, thus slackening the bite of the sharp edges 48 and bringing the curved surfaces 44 into contact with the web 10.

When the wearer tightens the belt, the rotation of the tube 38 causes the the cam surfaces 48 to snap in turn against the forward transverse member 28 thereby emitting a sound on each occasion. The number of these sounds can be noted in achieving the desired support and hence the wearer can achieve the same support on tightening the belt by counting the same number of sounds on each occasion when the belt is worn.

I claim:

1. In combination, a support belt and a buckle comprising an apertured frame having opposed forward and rearward transverse members, the latter secured to one end of said belt with the other end adapted to pass through said frame, means on the said other end for engagement with the outside of said belt after said passage, a slidably rotatable tubular member on said frame and movable towards and away from said forward transverse member, said tubular member having a pair of opposed planar faces joined by a pair of opposed curved faces, said faces providing a pair of opposed relatively sharp edges, the arrangement being such that, when said other end is passed through said frame, it is looped around said tubular member, then under said forward transverse member and, on tightening, said tubular member slides towards said forward tranverse member and rotates to engage one of said sharp edges with the belt against the underside of said forward transverse member and the other sharp edge at the same time engages the belt looped around the tubular member in order to maintain the belt in position after which said other end is engaged with the outside of said belt.

2. The combination defined in claim 1 wherein said belt has at least one detachable rubber component secured to the inside of said belt.

* * * * *